US006158260A

United States Patent [19]

Ginzburg

[11] Patent Number: 6,158,260

[45] Date of Patent: Dec. 12, 2000

[54] UNIVERSAL ROLL CROSSING SYSTEM

[75] Inventor: Vladimir B. Ginzburg, Pittsburgh, Pa.

[73] Assignees: Danieli Technology, Inc., Cranberry Township; International Rolling Mill Consultants, Inc., Pittsburgh, both of Pa.

[21] Appl. No.: 09/396,304

[22] Filed: Sep. 15, 1999

[51] Int. Cl.[7] ..... B21B 37/28

[52] U.S. Cl. ..... 72/9.1; 72/9.2; 72/11.7; 72/11.8; 72/366.2

[58] Field of Search ..... 72/8.9, 9.1, 9.2, 72/11.6, 11.7, 11.8, 365.2, 366.2, 12.7, 12.8

[56] References Cited

U.S. PATENT DOCUMENTS

| | | | |
|---|---|---|---|
| 1,860,931 | 5/1932 | Keller . | |
| 4,453,393 | 6/1984 | Hino et al. | 72/243 |
| 5,365,764 | 11/1994 | Kajiwara et al. | 72/229 |
| 5,657,655 | 8/1997 | Yasuda et al. | 72/11.5 |
| 5,666,837 | 9/1997 | Kajiwara et al. | 72/14.4 |
| 5,765,422 | 6/1998 | Donini et al. | 72/237 |
| 5,839,313 | 11/1998 | Ginzburg | 72/241.2 |
| 5,875,663 | 3/1999 | Tateno et al. | 72/9.2 |

FOREIGN PATENT DOCUMENTS

| | | |
|---|---|---|
| 5-237511 | 9/1993 | Japan . |

*Primary Examiner*—Ed Tolan

*Attorney, Agent, or Firm*—Armstrong, Westerman, Hattori, McLeland & Naughton

[57] ABSTRACT

A method for hot rolling and cold rolling metal strip to a finish strip thickness, profile and flatness in a series of rolling mills each having roll bending and roll crossing capabilities to effect a plurality of roll gap profiles. A control method utilizing mathematical models of the roll gap profiles and strip profile is used to select and set the roll bending and roll crossing to a preferred configuration based on secondary effects of possible combinations so as to produce finished metal strip having desired thickness, profile and flatness characteristics.

13 Claims, 11 Drawing Sheets

UNIVERSAL ROLL CROSSING SYSTEM

BACKGROUND OF THE INVENTION

1. Field of the Invention

The present invention relates to rolling of sheet metal strip in a rolling mill having roll crossing and bending systems for effecting strip profile and flatness and to a method for controlling the rolling mill. A series of hot and cold rolling mills having such systems and controls are used for obtaining desired thickness, profile and flatness for finished metal strip.

2. Description of Related Art

In the production of finished metal strip by hot and cold rolling operations it is advantageous to control the process so as to produce finished strip having a strip thickness, profile and flatness acceptable to the end user. During rolling, strip profile is controlled by varying the shape of the gap between work rolls of a rolling mill which is referred to as the roll gap profile. Such roll gap profile control can be carried out on mills having solely work rolls (2-high), work rolls with back-up rolls (4-high), work rolls with intermediate rolls followed by back-up rolls (6-high), or work rolls with multiple back up and/or intermediate rolls. Other variations wherein the number of top rolls differ from the number of bottom rolls are also possible. The roll gap profile can be controlled by means such as using non-cylindrically shaped rolls, roll axial shifting in combination with non-cylindrically shaped rolls, roll heating or cooling, roll bending, roll crossing and combinations of such methods.

U.S. Pat. No. 1,860,931 describes a 4-high rolling mill having roll crossing of solely back-up rolls.

U.S. Pat. No. 4,453,393 describes a 4-high rolling mill wherein work roll bending and crossing of both work rolls and back-up rolls is carried out. The roll crossing is a paired-crossing type wherein a work roll and its associated back-up roll are crossed to the same degree as a pair. An "equalizer beam" is used to accomplish such paired-crossing.

Japan Patent 5-237511 shows crossing of both the work rolls and the back-up rolls in a 4-high rolling mill. Angles of crossing are controlled so that axial thrust force resulting from contact of the work roll with the work product is cancelled, at least in part, by thrust force in the opposite direction resulting from contact of the work roll with the back-up roll.

U.S. Pat. No. 5,365,764 describes a 2-high rolling mill using solely work roll crossing to perform strip crown control.

U.S. Pat. No. 5,666,837 describes a 4-high rolling mill using crossing of both work rolls and back-up roll in combination with roll bending. It teaches use of a lubricant in the nip between each work roll and back-up roll to reduce axial thrust force in the mill.

U.S. Pat. No. 5,765,422 describes a 4-high rolling mill wherein crossing of both the work rolls and back-up rolls is carried out with use of at least one motion transmission mechanism for cross displacement of the rolls.

U.S. Pat. No. 5,839,313 describes crossing of solely intermediate rolls in a 6-high or 5-high rolling mill to eliminate the disadvantages of work roll crossing.

SUMMARY OF THE INVENTION

The present invention uses roll crossing and roll bending in a 4, 5 or 6-high rolling mill. A plurality of roll crossing configurations in combination with both positive and negative roll bending of solely the work rolls or both the work rolls and intermediate rolls are used to provide a multitude of roll gap profiles for use in controlling the strip profile and flatness. In many cases different combinations of roll bending and crossing can result in the same roll gap profile.

In the disclosure, strip profile refers to the shape of a cross-section of the strip in a plane perpendicular to the longitudinal axis of the strip; flatness refers to the property of the strip whereby the entire surface of a strip would lie in a single plane if the strip were placed on a planar surface; and roll gap profile refers to the shape of the gap between work rolls of a rolling mill through which the workpiece passes.

A rolling system is disclosed wherein profile and flatness characteristics of metal strip entering a rolling mill are measured so as to enable selection of the best roll bending and roll crossing combination of the rolling mill for achieving the roll gap profile to result in finished metal strip having a desired strip thickness, profile and flatness. An optimum combination of bending and crossing is selected, based on roll gap profile desired and secondary effects of such bending and crossing combinations.

Other specific features and contributions of the invention are described in more detail with reference being made to the accompanying drawings.

DETAILED DESCRIPTION OF THE INVENTION

Figure 1:
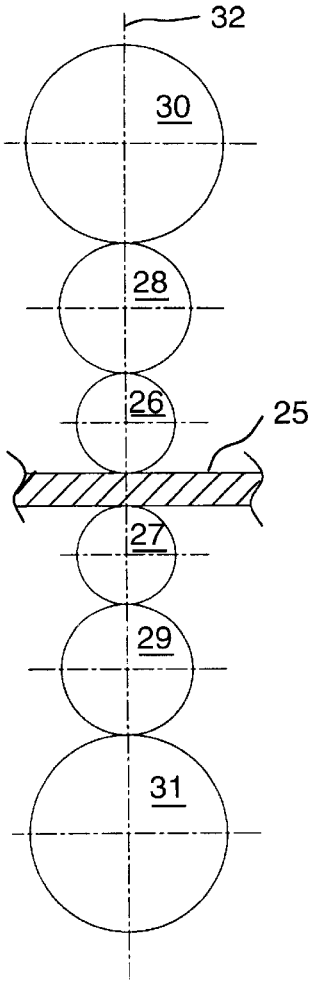
FIG. 1 is a schematic end elevational view of the rolls of a 6-high rolling mill of the invention absent any roll crossing.

The strip profile and flatness control system of the invention is used for controlling both hot and cold rolling of metal strip. Ideally, for most end uses, flat rolled continuous strip finished product would have the same specified thickness dimension from edge to edge over the entire length of the strip and would be flat over all of its surface area. That is no waves, ripples or buckles would be present on any area of the strip.

Such uniform thickness dimension is not practical during rolling as continuous metal strip having a uniform thickness from edge to edge, when cold rolled between work rolls having parallel roll surfaces at the roll gap is difficult to track and tends to drift from a centerline of the mill. A relative strip crown of up to a few percent of the thickness in the center of the strip facilitates tracking of the strip. Such difference in thickness is typically up to a few thousandths of an inch. Metal strip having a center crown is acceptable for most finished product applications. Non-flatness in the strip however, wherein waves, ripples and/or buckles are present, is objectionable for many finished product applications as it is usually very apparent. An acceptable finished product, in most cases, is a flat strip having a relative strip center crown of about 1–3 percent. Such properties in a strip are difficult to achieve in practice for many reasons including uneven wearing of roll surfaces, thermal crowning of the rolls during rolling operations, elastic deformation of the rolls and mill stands, and differences in strip temperature from beginning to end of a coil of continuous strip, especially during hot rolling.

A portion of a strip surface develops a wave or buckle when that portion is subjected to thickness reduction differing from thickness reduction of its surrounding area. Either too much or too little metal surface area is present in the defective area, compared with the size of that area as measured in a plane, and a buckle or wave results. To obtain a flat finished product the same percentage reduction in thickness must be carried out at all areas of the strip during every rolling pass, beginning with the hot rolling pass in which the strip has cooled to a temperature below which plastic flow of the rolled metal in the transverse direction is restricted. At temperatures at which plastic flow of the metal in transverse direction can occur easily flatness is usually not a problem as the metal can adjust to localized differences in reduction. Ideally, in the first hot rolling pass in which plastic deformation of the metal in transverse direction easily occurs, the continuous strip would have the desired relative center crown and such crown would be uniform from the beginning of the strip to the end of the strip. Then, in every subsequent rolling pass, the same relative center crown would be maintained so as to result in a flat finished strip. Factors mentioned above make such ideal rolling practice difficult to achieve. In a hot rolling operation consisting of six stands, for example, the desired relative center crown is established over the first three stands and the established relative center crown is maintained on remaining stands four through six.

In case of cold rolling, the plastic flow of metal in transverse direction is negligibly small. Therefore, to obtain flat strip, it is necessary to maintain the same relative strip center crown after each rolling pass.

In light of such difficulty, strip profile control of the invention is a method which can be carried out to obtain acceptable flat finished products on "non-ideal" work product resulting from such last rolling mill pass in which plastic flow of metal in transverse direction does easily occur. In such strip profile control practice, by matching the profile of the roll gap with the desired profile of the strip being rolled, strip flatness can be maintained. Matching of roll gap profile to desired strip profile must be carried out on every rolling pass and matched continuously along the length of the strip.

The process of the present invention carries out such profile matching by measuring the strip profile of the strip entering the mill (entry strip profile) so as to determine the roll gap profile required, then sets such roll gap profile by means of roll crossing and roll bending. When more than one roll crossing and roll bending combination results in the same roll gap profile, a preferred arrangement is determined and effected. Such preferred arrangement is based on secondary effects caused by roll bending and crossing which are described below. The strip profile is not measured directly but is arrived at by obtaining a series of strip thickness measurements across the width of the strip and combining them to define the strip profile.

The process of the invention can be carried out on 4, 5 and 6 high rolling mills. A 6-high rolling mill is used as an example to disclose the process. An increase in the number of rolls in the rolling mill increases the number of roll crossing and roll bending combinations.

FIG. 1 schematically depicts a 6-high rolling mill for thickness gauge reduction of continuous metal strip 25. The strip is engaged by top and bottom work rolls 26 and 27 respectively. To limit deflection of such work rolls a series of "back-up" rolls are used. Next in sequence are top located roll 28 and bottom located roll 29, referred to as intermediate rolls followed by top and bottom located rolls 30 and 31 respectively, referred to as back-up rolls. As depicted in FIG. 1, the central axis of each of the rolls lies in a single vertical plane indicated at 32 and all the axes are oriented perpendicular to the direction of the strip travel. No roll crossing is depicted in this figure.

FIGS. 2–12 depict the same 6-high rolling mill with its rolls crossed in differing arrangements. That is, the central axis of a crossed roll has been rotated in a horizontal plane so as to be oriented at an angle to the direction of strip travel other than perpendicular. Such crossing, exaggerated in the figures for clarity, is typically in a range of 1–2 degrees from perpendicular to the direction of strip travel.

Figure 2:
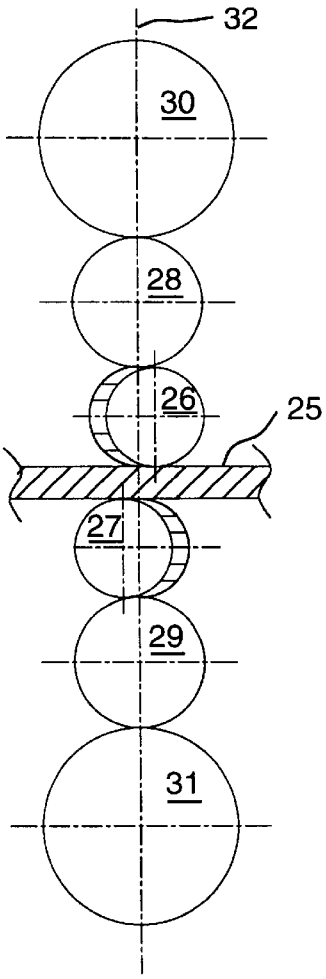
FIG. 2 is a schematic end elevational view of the rolls of a 6-high rolling mill of the invention, wherein work rolls are crossed.
Figure 3:
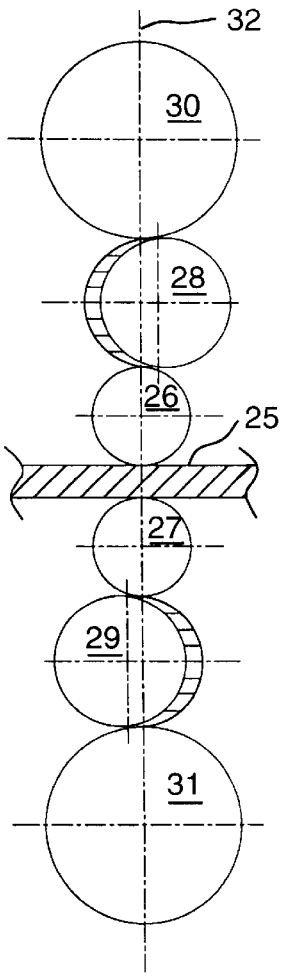
FIG. 3 is a schematic end elevational view of the rolls of a 6-high rolling mill of the invention wherein intermediate rolls are crossed.
Figure 4:
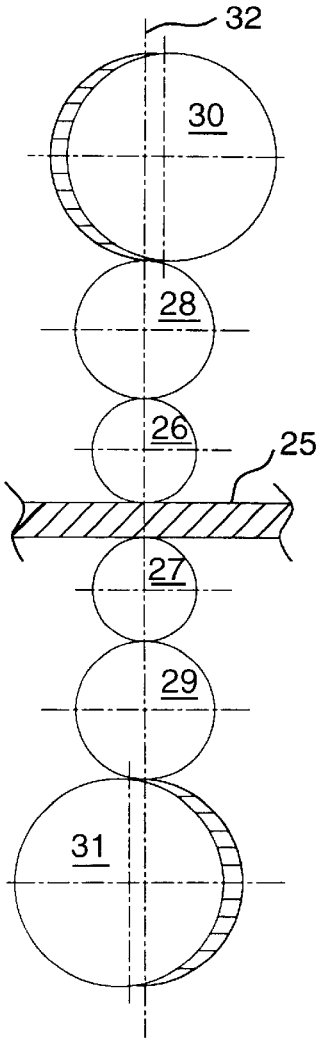
FIG. 4 is a schematic end elevational view of the rolls of a 6-high rolling mill of the invention, wherein back-up rolls are crossed.
Figure 5:
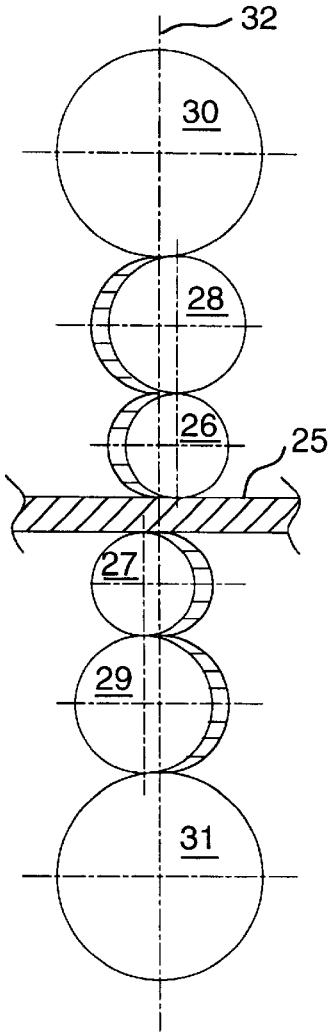
FIG. 5 is a schematic end elevational view of the rolls of a 6-high rolling mill of the invention wherein work rolls and intermediate rolls are in paired crossing.
Figure 6:
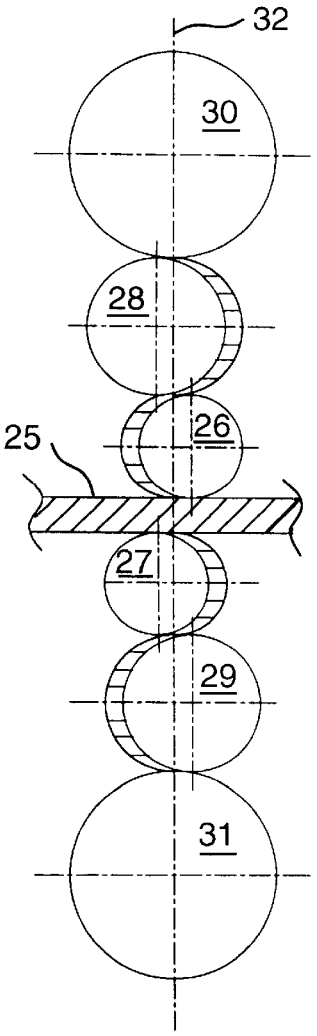
FIG. 6 is a schematic end elevational view of the rolls of a 6-high rolling mill of the invention wherein work rolls and intermediate rolls are in dual crossing.
Figure 7:
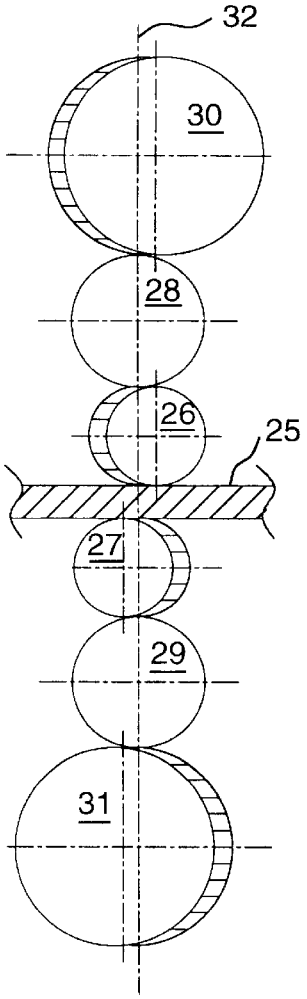
FIG. 7 is a schematic end elevational view of the rolls of a 6-high rolling mill of the invention wherein work rolls and back-up rolls are in paired crossing.
Figure 8:
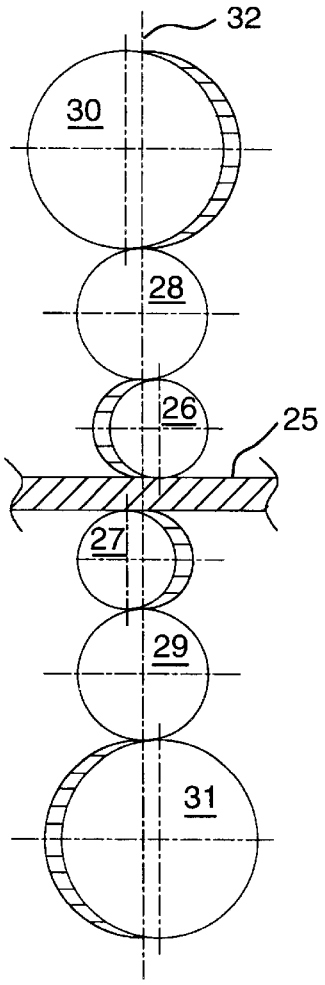
FIG. 8 is a schematic end elevational view of the rolls of a 6-high rolling mill of the invention wherein work rolls and back-up rolls are in dual crossing.
Figure 9:
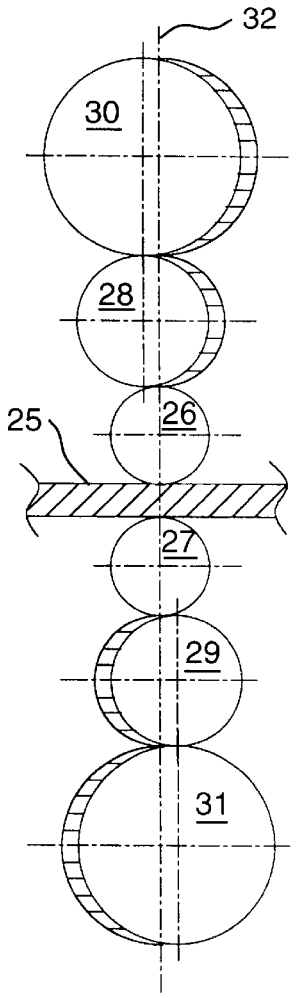
FIG. 9 is a schematic and elevational view of the rolls of a 6-high rolling mill of the invention wherein intermediate rolls and back-up rolls are in paired crossing.
Figure 10:
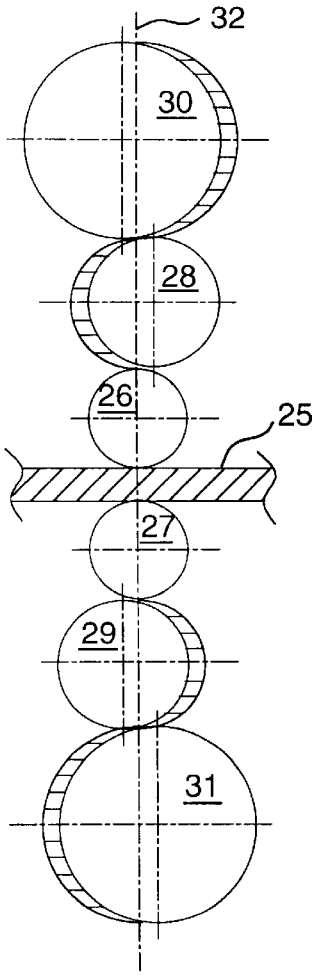
FIG. 10 is a schematic and elevational view of the rolls of a 6-high rolling mill of the invention wherein intermediate rolls and back-up rolls are in dual crossing.
Figure 11:
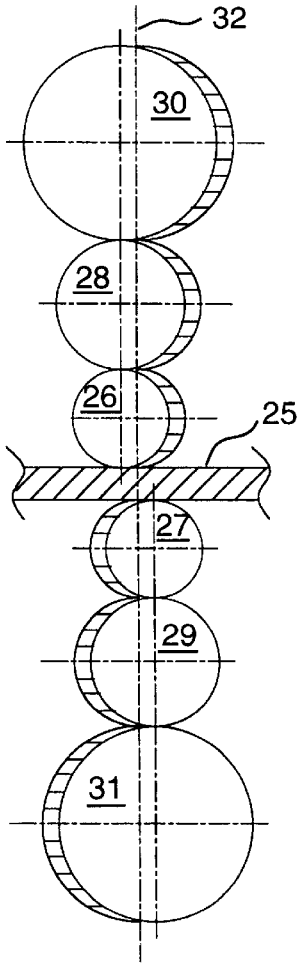
FIG. 11 is a schematic and elevational view of the rolls of a 6-high rolling mill of the invention wherein all of the rolls are in paired crossing.
Figure 12:
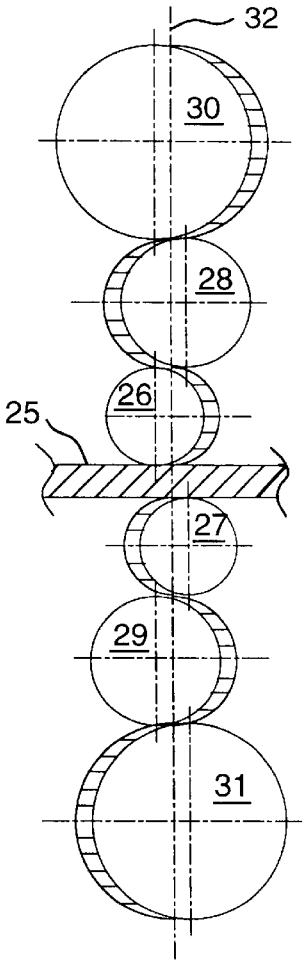
FIG. 12 is a schematic and elevational view of the rolls of a 6-high rolling mill of the invention wherein all of the rolls are in dual crossing.

Depicted in FIGS. 2, 3 and 4 respectively are examples wherein only work rolls, intermediate rolls or back up rolls are crossed, in FIGS. 5–10 combinations of those types of rolls are crossed. FIGS. 11 and 12 depict embodiments wherein all of the rolls are crossed. In FIGS. 5, 7, 9 and 11 the rolls are said to have "pair crossing" as the crossed top rolls, for example, are all rotated in the same direction in horizontal planes and also the crossed bottom rolls are all rotated in the same direction. FIGS. 6, 8, 10 and 12 are examples of "dual crossing" as crossed top rolls, for example, are rotated in opposite directions in horizontal planes in relation to each other. Although not shown in FIGS. 2–12, in carrying out the process of the invention, the crossing combination of top rolls does not have to match the crossing combination of bottom rolls and the degree of crossing for any roll can vary.

Figure 13:
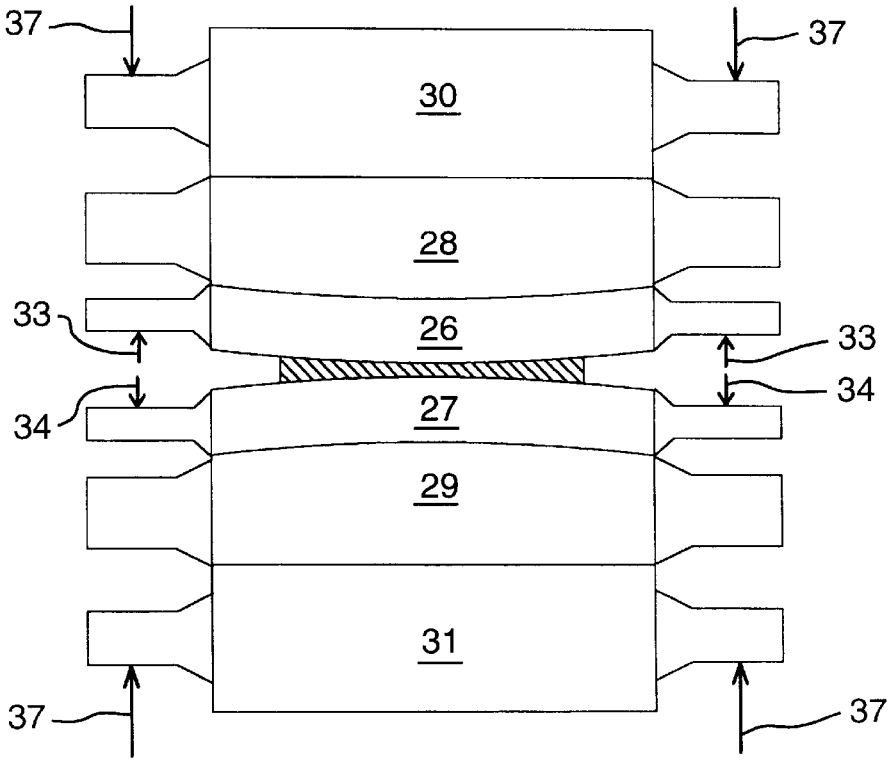
FIG. 13 is a schematic elevational view of a 6-high rolling mill of the invention with positive bending of the work rolls.
Figure 14:
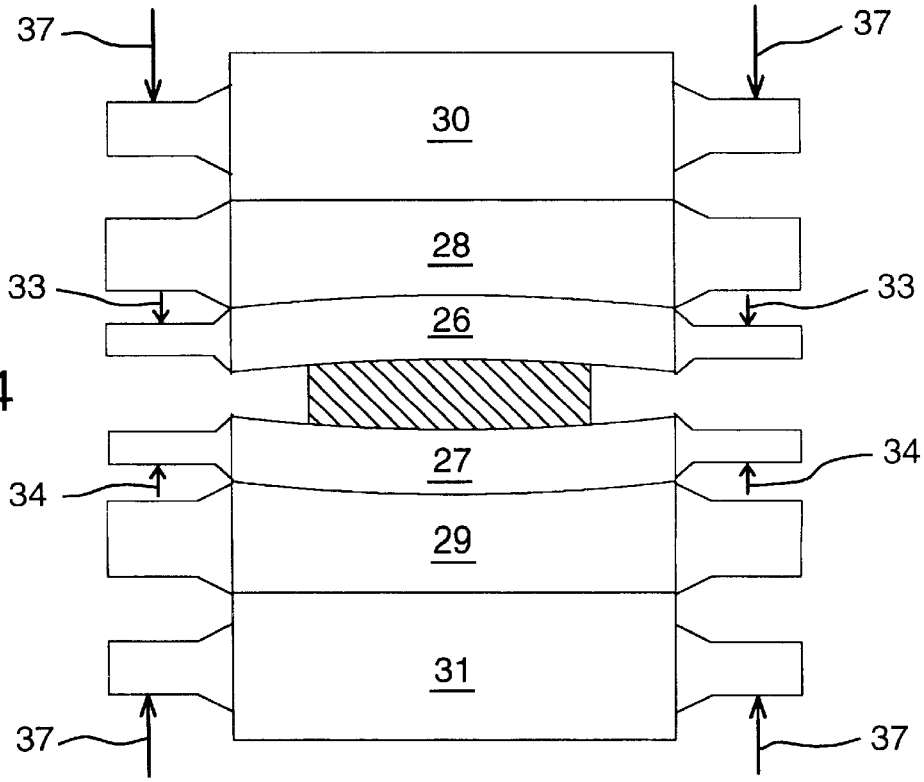
FIG. 14 is a schematic elevational view of a 6-high rolling mill of the invention with negative bending of the work rolls.
Figure 15:
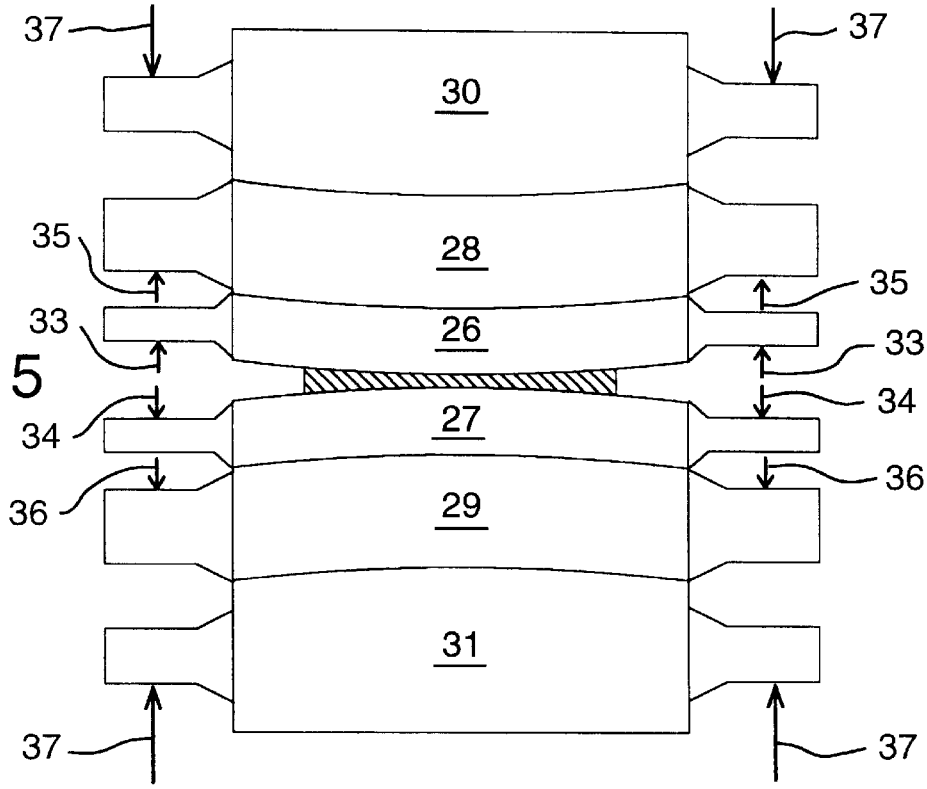
FIG. 15 is a schematic elevational view of a 6-high rolling mill of the invention with positive bending of the work rolls and intermediate rolls.
Figure 16:
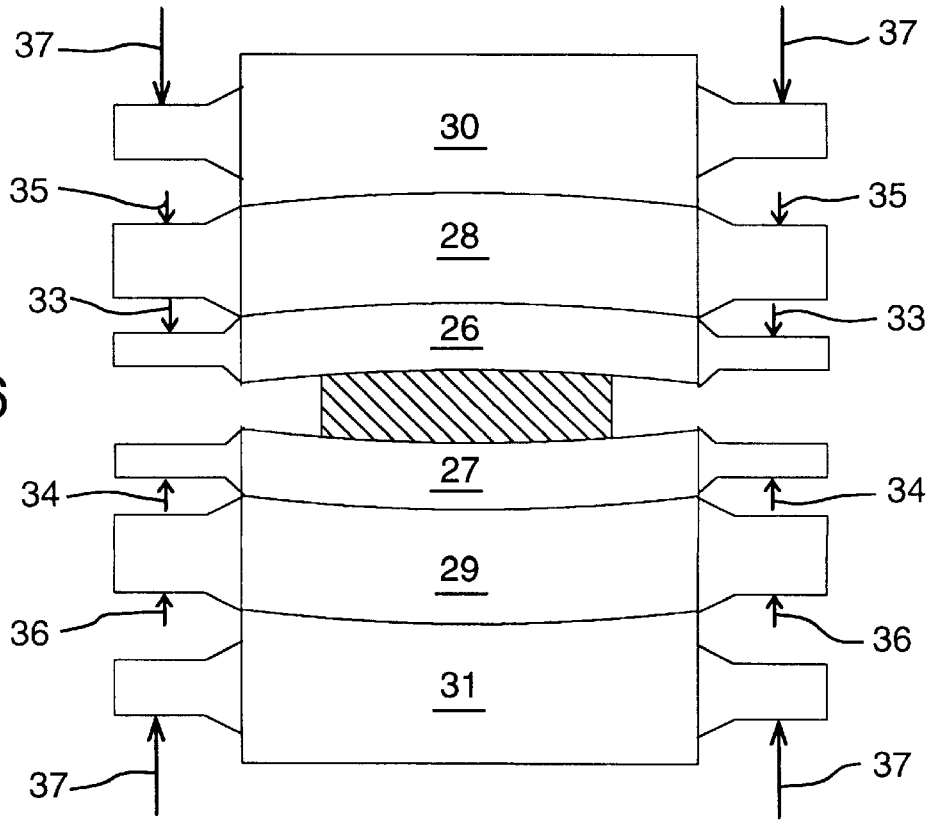
FIG. 16 is a schematic elevational view of a 6-high rolling mill of the invention with negative bending of the work rolls and intermediate rolls.

In addition to roll crossing to achieve roll gap profiling, roll bending can be carried out alone or in combination with roll crossing. FIGS. 13–16 depict various roll bending configurations for a 6-high rolling mill. FIG. 13 depicts positive roll bending of both top and bottom work rolls 26 and 27. FIG. 14 depicts negative roll bending of both top and bottom work rolls 26 and 27. FIGS. 15 and 16 depict positive and negative bending of both work rolls 26 and 27, and intermediate rolls 28 and 29 respectively. In FIGS. 13–16 bending forces are applied at axial ends of the rolls in a vertical direction in either a positive or negative manner to achieve the roll bending. In FIG. 13, forces 33 and 34 are applied for positive bending of work rolls 26 and 27. In FIG. 14, forces 33 and 34 are applied for negative bending of work rolls 26 and 27. In FIGS. 15 and 16 in addition to bending forces on the work rolls, bending forces are exerted on intermediate rolls 28 and 29. Forces 35 and 36 exert positive bending forces on intermediate rolls 28 and 29 in FIG. 15; and in FIG. 16 forces 35 and 36 exert negative bending forces on intermediate rolls 28 and 29. In FIGS. 13–16, screw down force (rolling force), which acts on axial ends of back up rolls 30 and 31, is depicted by arrows 37.

In addition to the above bending combinations, the magnitude of the bending forces and screw down force can be varied on each end of the roll and in configurations wherein both work and intermediate rolls are bent, bending forces for work rolls need not be the same as for intermediate rolls.

It can be seen from the above examples of roll crossing and roll bending that a multitude of combinations and forces are possible when the roll gap profiling techniques of roll crossing and roll bending are combined.

Figure 17:
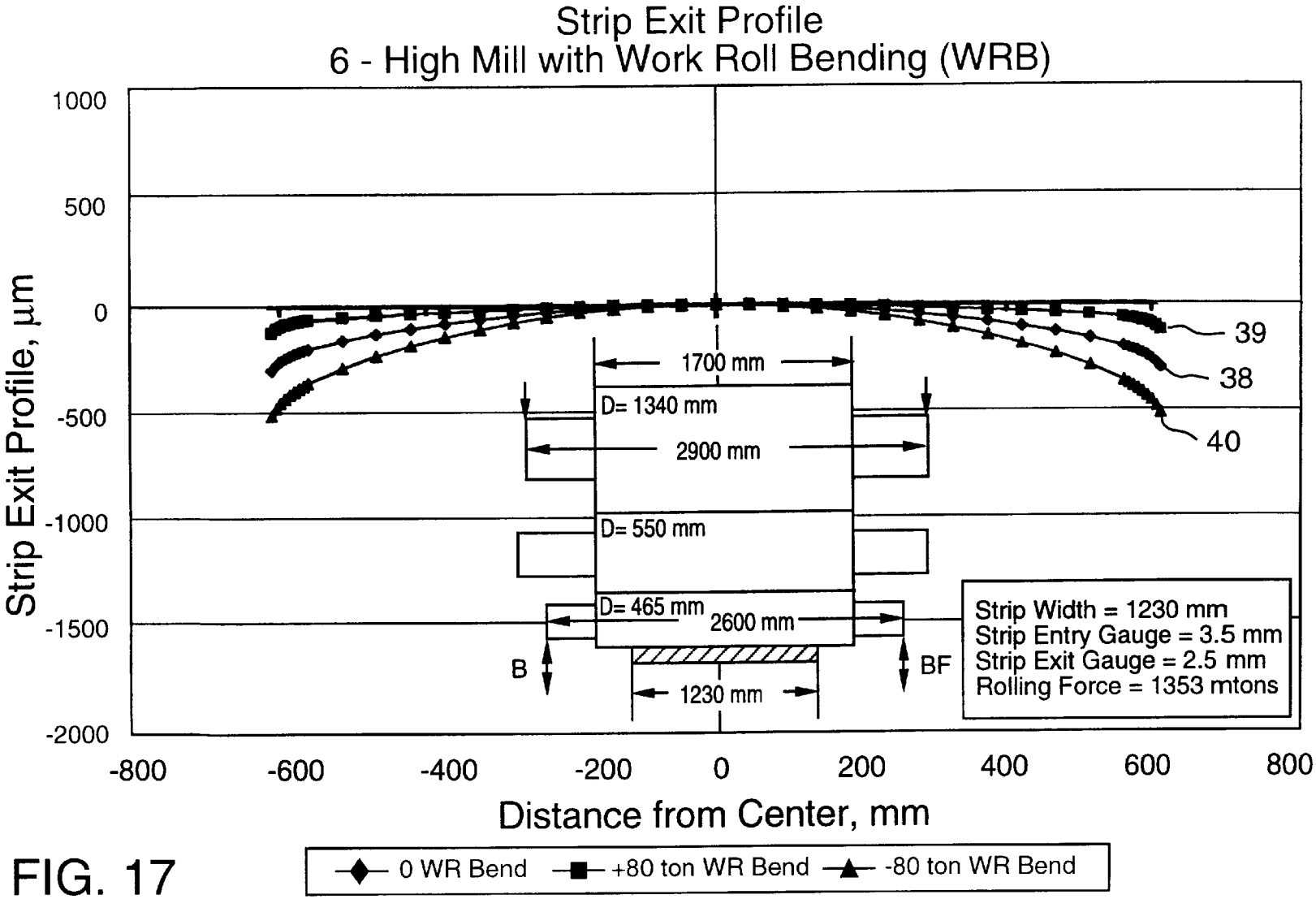
FIG. 17 is a graph of "strip exit profile" versus "distance from the strip center" for a set of work roll bending combinations of the invention.
Figure 18:
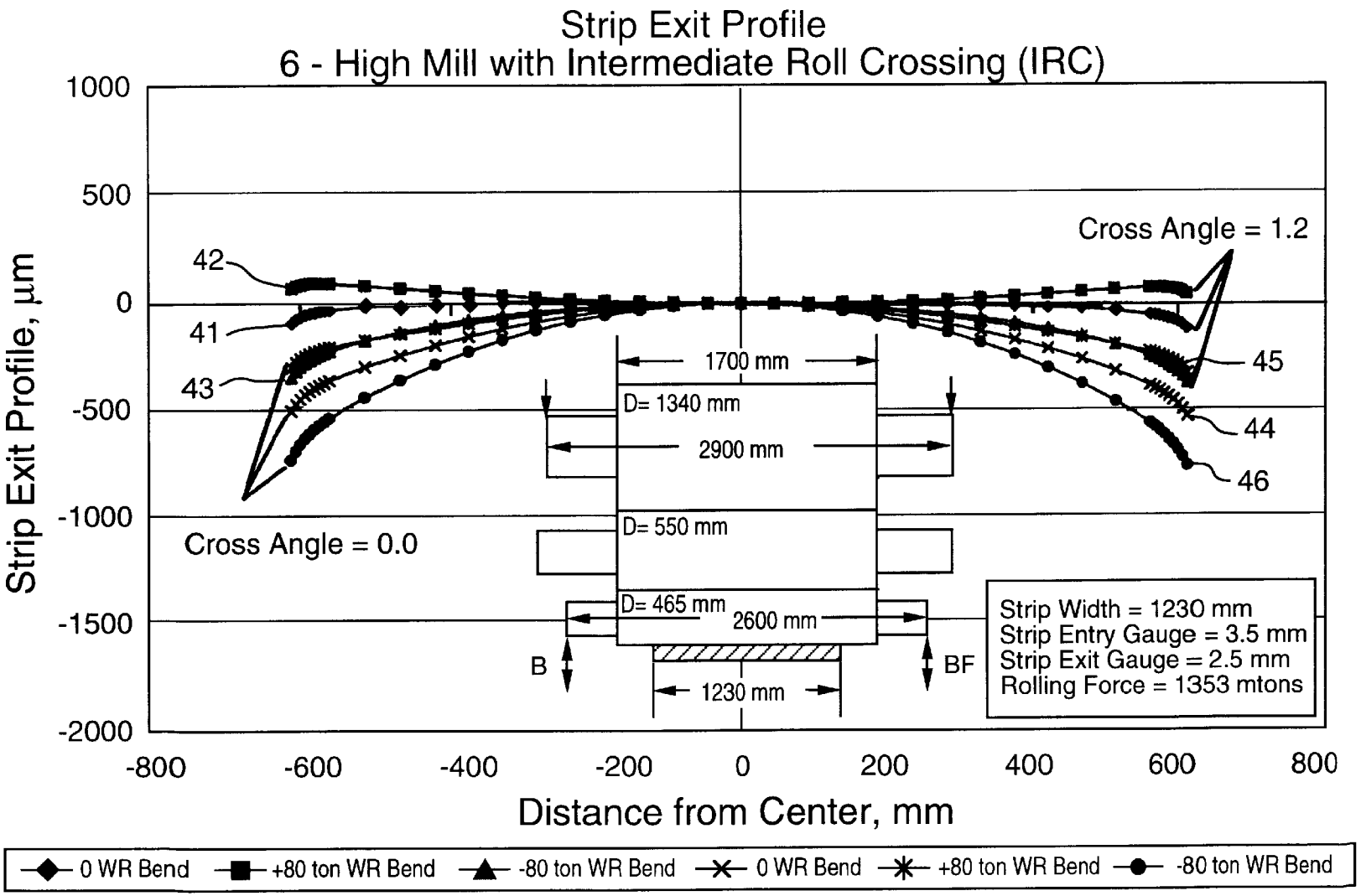
FIG. 18 is a graph of "strip exit profile" versus "distance from the strip center" for a set of work roll bending and intermediate roll crossing combinations for the roll crossing configuration of FIG. 3.
Figure 19:
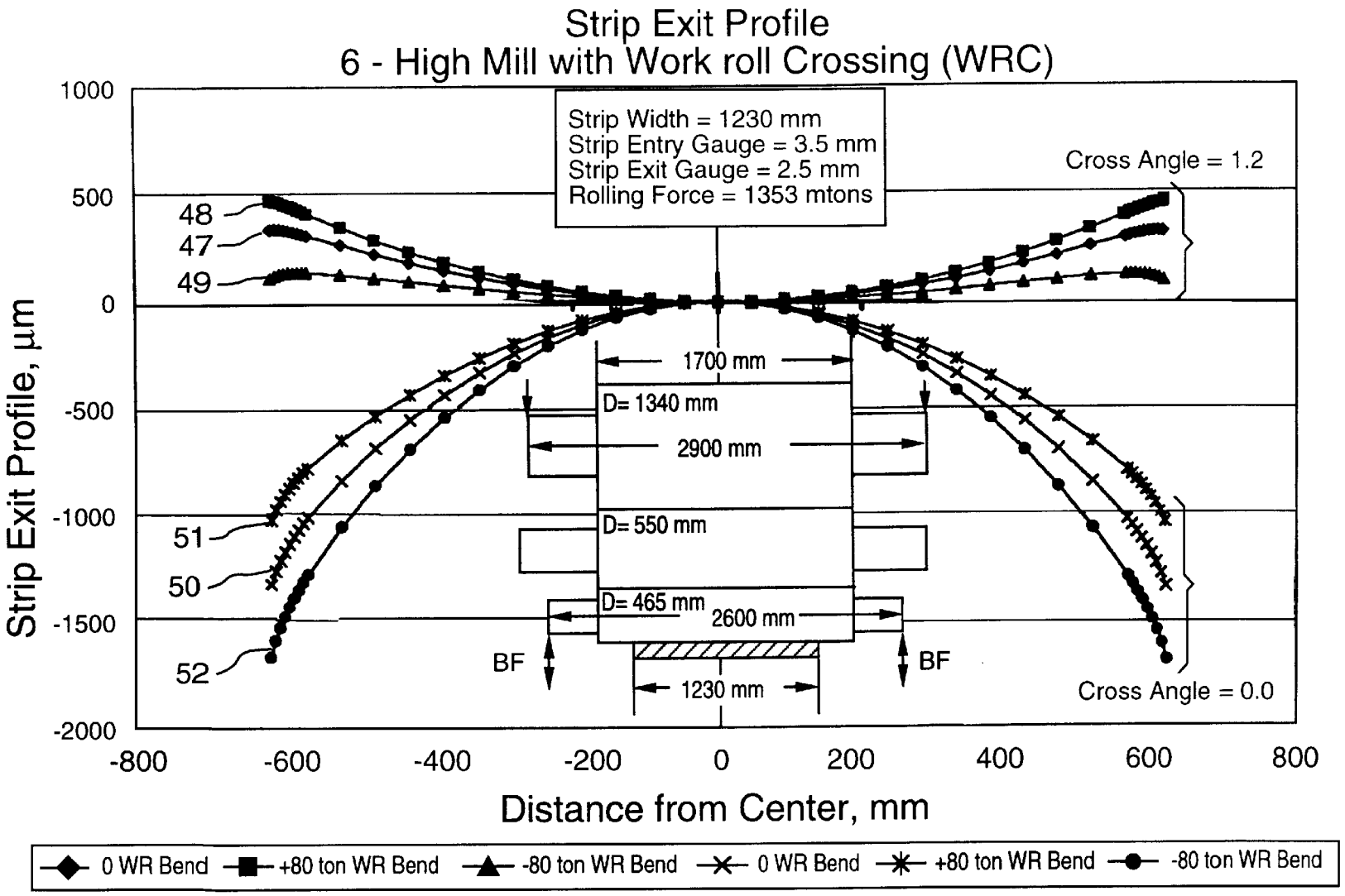
FIG. 19 is a graph of "strip exit profile" versus "distance from the strip center" for a set of work roll bending and work roll crossing combinations for the roll crossing configuration of FIG. 2.

FIGS. 17–19 are examples of graphs of strip profiles resulting from rolling strip in a rolling mill having various roll crossing and bending combinations to obtain various roll gap profiles. It is assumed that the profile of the strip exiting the rolling mill (exit strip profile) matches the roll gap profile of the mill. Since the profiles and thus the graphs differ for each set of conditions, and for factors such as length and diameter of work rolls, intermediate rolls and back up rolls as well as strip width, strip thickness, percent reduction in thickness and rolling force, a graph can be charted specific to each set of conditions. FIG. 17–19 are graphs of strip exit profiles for a metal strip and a rolling mill having the following characteristics:

| | |
|---|---|
| Roll crossing angle (where crossing is indicated) | 1.2° |
| Work roll (distance between center lines of roll bearings) | 2600 millimeter |
| Work roll (diameter) | 465 millimeter |
| Intermediate roll (distance between center lines of roll bearings) | 2900 millimeter |
| Intermediate roll (diameter) | 550 millimeter |
| Back-up roll (distance between center lines of roll bearings) | 2900 millimeter |
| Back-up roll (diameter) | 1340 millimeter |
| Barrel length of all rolls | 1700 miilimeter |
| Strip width | 1230 millimeter |
| Strip entry gauge | 3.5 millimeter |
| Strip exit gauge | 2.5 millimeter |
| Rolling force | 1353 metric tons |

On each of the graphs, the horizontal axis denotes distance in millimeters (mm) from the center of the strip and the vertical axis denotes the variation in strip thickness in micrometers ($\mu$m). The thickness at the center of the strip is used as a reference. A positive 100 $\mu$m for example, denotes a strip thickness 100 $\mu$m thicker than that at the center of the strip; a negative 200 $\mu$m for example, denotes a strip thickness 200 $\mu$m thinner than that at the center of the strip. Points along the plotted curves are arrived at by solving three dimensional finite element equations.

A family of curves (38, 39 and 40) is plotted on the graph of FIG. 17 for the following roll bending force combinations with no roll crossing:

| | |
|---|---|
| Curve 38 | bending force = 0 |
| Curve 39 | a positive bending force of 80 ton on both work rolls |
| Curve 40 | a negative bending force of 80 ton on both work rolls |

A family of curves 41–46 is plotted on the graph of FIG. 18 for the following roll bending forces in combination with crossing of the intermediate rolls in three of the curves.

| | |
|---|---|
| Curve 41 | bending force = 0 and intermediate rolls crossed 1.2° |
| Curve 42 | a positive bending force of 80 ton on both work rolls and intermediate rolls crossed 1.2° |
| Curve 43 | a negative bending force of 80 ton on both work rolls and intermediate rolls crossed 1.2° |
| Curve 44 | bending force = 0 and no roll crossing |
| Curve 45 | a positive bending force of 80 ton on both work rolls and no roll crossing |
| Curve 46 | a negative bending force of 80 ton on both work rolls and no roll crossing |

On the graph of FIG. 19 a family of curves 47–52 is plotted for the following roll bending forces in combination with crossing of the work rolls in three of the curves.

| | |
|---|---|
| Curve 47 | bending force = 0 and crossing of the work rolls 1.2° |
| Curve 48 | a positive bending force of 80 ton on both work rolls and crossing of the work rolls 1.2° |
| Curve 49 | a negative bending force of 80 ton on both work rolls and crossing of the work rolls 1.2° |
| Curve 50 | bending force = 0 and no roll crossing |
| Curve 51 | a positive bending force of 80 ton on both work rolls and no roll crossing |
| Curve 52 | a negative bending force of 80 ton on both work rolls and no roll crossing |

Strip profiles such as those found in the graphs of FIGS. 17–19, can be determined by solving three dimensional finite element equations for all possible combinations of roll bending and crossing and for all possible work product to be processed in a mill. Such method for determining roll gap profile is described in Ginzburg, V. B. *High-Quality Steel Rolling Theory and Practice*, Marcer Dekker, Inc. 1993-Chapter 21, which is incorporated herein by reference. In such determination, the effect of roll crossing on the strip profile can be considered by using an equation for the equivalent amount of roll crown, $C_{eq}$. Equivalent roll crown description and equation are found in such reference on pages 664–665. A data base of such profiles, defined in mathematical terms (described below), is a part of a control system for the process of the invention.

In the process of the invention the profile of the incoming strip is determined with use of strip thickness measurements and an appropriate roll gap profile is set in the rolling mill so as to reduce the strip thickness without causing buckles or waviness in the strip. The shape of the entry strip profile and the roll gap profile can be mathematically defined by a well-known curve-fitting a polynomial function to the shape of the profile. One example of such a function is a 4th order polynomial expression such as $$y=A_1X+A_2X^2+A_3X^3+A_4X^4$$

where:

y=variation in strip thickness $A_1$ through $A_4$=strip profile coefficients of the first through 4th order polynomial term X=normalized distance from the roll center expressed as:

$$X=\frac{x}{w/2-x_e}$$

where:

x=distance from the strip center w=strip width $X_e$=length of unmeasured strip profile from the strip edge (A length of about 25 mm at the strip edge is not used when defining the strip profile);

Such curve-fitting of a polynomial function to the shape of the profile, referred to as strip profile spectral analysis is described in Tellman, J. G. M., et al. "Shape Control with CVC in a Cold Strip Mill—Development and Operational Results," Proceedings of the 5th International Rolling Conference: Dimensional Control in Rolling Mills, Institute of Metals, London, Sep. 11–13, 1990, pp. 260–269 which is incorporated herein by reference. In such polynomial function the numerical range of each of the strip profile coefficients ($A_1$ through $A_4$) provides a measure of the capability of a certain roll bending and/or crossing configuration to change the roll gap profile and thus the strip profile. The larger the numerical range the more the strip profile can be changed. Such coefficients can be determined by the profile spectral analysis. The ranges for various configurations of roll bending and crossing are shown in FIG. 20.

Figure 20:
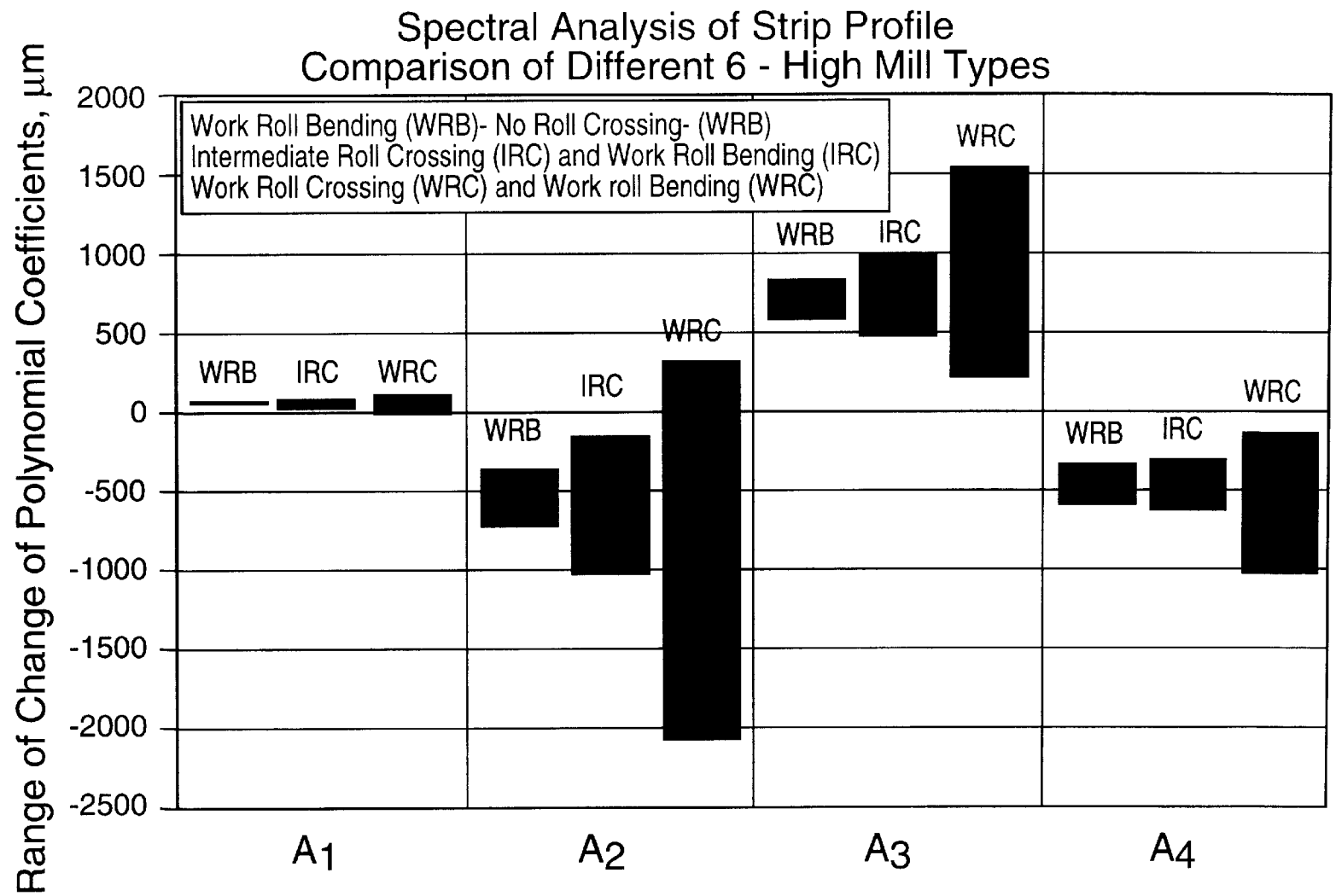
FIG. 20 is a graph of coefficients for polynomial functions defining strip profiles resulting from different combinations of roll bending and roll crossings of the invention.

FIG. 20 shows the ranges of coefficients $A_1$, $A_2$, $A_3$ and $A_4$ for three possible cases of roll bending and crossing:

WRB—work roll bending and no roll crossing

IRC—intermediate roll crossing combined with work roll bending

WRC—work roll crossing combined with work roll bending

It is evident from FIG. 20 that work roll bending (WRB) alone provides the smallest range of strip profiles obtainable, while crossing the work rolls in combination with work roll bending (WRC) provides the largest range. For example, coefficient $A_2$, for work roll bending alone, the range is from about −800 to −400 $\mu$m compared with the range for work roll crossing in combination with work roll bending which is from about −2100 to +300. The ranges for coefficients wherein intermediate roll crossing in combination with work roll bending is carried out, are intermediate the above examples.

Figure 21:
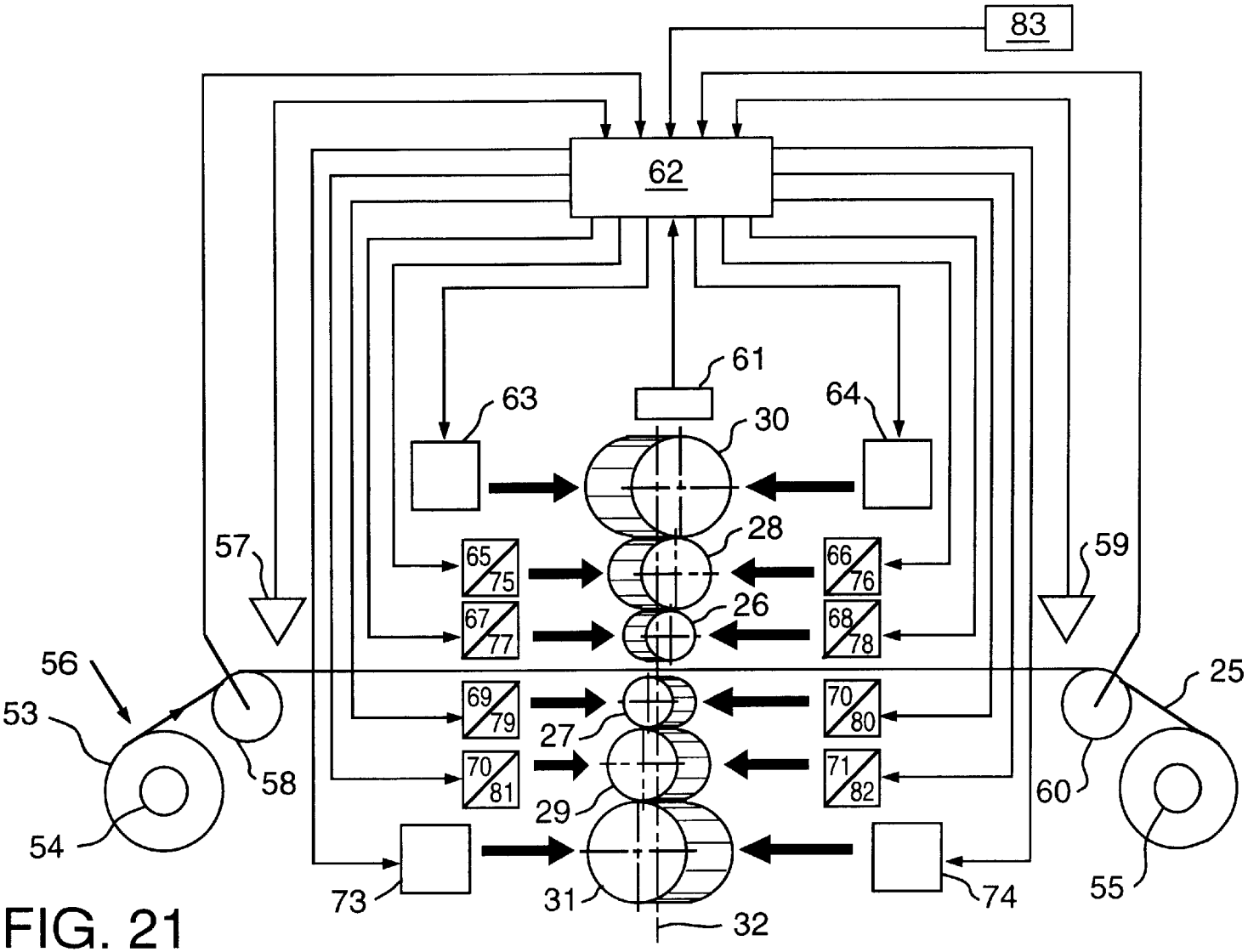
FIG. 21 is a schematic diagram depicting control means of the invention for obtaining desired strip profile and flatness.

FIG. 21 is a schematic block diagram depicting control apparatus of the invention for use in describing the process of the invention. Rolls 26, 27, 28, 29, 30 and 31 of the 6-high rolling mill are depicted processing continuous metal strip 25. Strip 25 is delivered from coil 53 on tension reel 54 to the rolling mill and recoiled on tension reel 55. The direction of travel is indicated by arrow 56. It is to be understood that such control means for practicing the process of the invention are present on each stand of a series of stands of the hot rolling operation and each stand of a series of stands of the subsequent cold rolling operation. In a series of stands uncoiling and coiling would only occur before the initial stand and following the final stand. Such hot rolling operation described is that following a roughing mill or a continuous casting operation. The cold rolling process reduces the strip to finished gauge. The process of the invention can be carried out on a single stand. However without carrying out the process at each gauge reduction, a finished product having the desired strip profile and flatness is most likely not attainable.

The profile of the metal strip entering a rolling mill of the invention is determined with use of strip thickness measurements across the strip width with thickness gauge means 57 such as x-ray analysis and strip flatness is measured by flatness gauge 58 such as a shapemeter roll. The profile of the metal strip exiting the mill is determined with use of measurements with thickness gauge means 59 and strip flatness is measured by flatness gauge means 60. Load cells such as 61 measure roll separating force of the mill at each end of the backup roll. Such methods, and others, are described in the above incorporated reference by V. B. Ginzburg at chapters 6 and 9. All of the above sensors send information to controller 62, which can consist of a programmable logic controller (PLC). In a reversing mill, operation of the entry and exit sensing means can function in reverse. Strip flatness and thickness information is sent to controller 62 wherein analysis is carried out with use of the data base of mathematical functions described above to determine the optimum roll crossing and bending configuration to provide the appropriate roll gap profile. Following such determination, roll crossing actuators 63–74 and roll bending actuators 75–82 are utilized to provide such roll gap profile.

The strip profile and flatness control system functions during early passes of hot rolling, when strip temperature is such that plastic flow in transverse direction can easily occur, by the following method:

1) entry strip thickness sensor 57 measures the actual entry strip thickness at a series of locations across the width of the strip, entry strip flatness sensor 58 measures the actual entry strip flatness and the information is sent to controller 62. (The pass in which plastic flow of the metal in transverse direction no longer takes place during hot rolling can be determined prior to rolling based on entry metal temperature, thickness and width along with characteristics of the rolling mill. Such determination process is known in the art);

2) controller 62, with such measured thickness and flatness information and a target strip profile entered at 83, determines the entry strip profile, calculates the desired exit strip profile and thus the roll gap profile needed to attain the exit strip profile. (The target strip profile must be attained while the strip is still at a temperature at which plastic deformation can easily occur);

3) controller 62 employs the mathematical functions that correspond to the desired exit strip profile and compares them with the mathematical functions defining the available configurations of roll bending and roll crossing stored in the data base as described above;

4) all of the possible configurations for providing the desired profile are determined, then the configuration having the minimum secondary effects (described below) is selected;

5) exit strip thickness sensor 59 and flatness sensor 60 measure resulting exit strip thickness and flatness respectively and controller 62 determines the exit strip profile than compares such exit strip profile and flatness with the desired strip profile and flatness to develop a correction factor, if necessary, to adjust the roll bending and/or crossing configuration.

The secondary effects of roll crossing and bending referred to above comprise:

1) crossing of work rolls causes a number of undesirable effects including:
   a) strip profile distortion wherein the cross section of the strip becomes trapezoidal in shape;
   b) "strip walking" wherein the strip tracks to a non-centered position in the rolling mill;
   c) difficulty in threading the strip when longitudinal tension is not present;
   d) complications with mill "zeroing" and "leveling" during mill set-up;

2) "pair roll crossing" creates axial thrust forces on the crossed rolls, such forces are not opposed by oppositely directed axial thrust forces (as in 3 below);

3) "dual roll crossing" creates axial thrust forces on certain rolls. However, in some rolls, an oppositely directed axial thrust force reduces the total axial thrust force on such rolls. Also, a work roll crown of a selected value can be achieved by dual crossing two rolls to opposite angles of about half the degree that is required when the same two rolls are pair crossed;

4) crossing of solely the intermediate roll creates axial thrust forces, however since the work rolls are not crossed there are no adverse effects on the strip cross-sectional profile, strip tracking, mill leveling and zeroing.

In selecting the preferred roll crossing and bending configuration based on the secondary effects, the order of preference is:

1) roll bending without roll crossing (most preferred);
2) intermediate roll crossing;
3) dual roll crossing;
4) pair roll crossing;
5) work roll crossing;

Another consideration when selecting the preferred configuration is the time required to set roll bending and roll crossing. Roll bending or un-bending is accomplished in less time than roll crossing or uncrossing. In practice, changes in entry strip profile along the length of the strip most often occur gradually and such time considerations for making roll gap profile changes are not a factor in determining the best configuration of roll bending and crossing.

Operation of the control system, as described above, is carried out during early passes of hot rolling (for example at hot rolling stands one through three) when the strip is still hot enough to be easily plastically deformed. During such passes the target profile (for example a 2% center crown) can be attained gradually over those passes. During "final" hot rolling passes, for example stands 4–6, as well as during all "cold rolling" passes the relative strip profile can not be changed without incurring problems with flatness. Therefore, the relative strip profile attained during the early hot rolling passes is that which must be maintained during all subsequent rolling passes, even if it varies from the target strip profile desired for the finished strip; otherwise strip flatness will not be achieved.

During such subsequent rolling passes the strip profile and flatness control system functions by the following method: 1) controller 62 receives the entry strip thickness measurements from sensor means 57 determines the entry strip profile and controls the roll bending and roll crossing so as to match the roll gap profile to the entry strip profile. The same mathematical function and selection of the preferred roll bending and roll crossing configuration as described above is used during such "matching" stage of rolling; 2) exit strip measurement means 59 and 60 are used to verify intended strip profile and develop a correction factor if necessary when the entry strip profile does not match the exit strip profile.

While specific dimensional data, rolling mill configurations, and processing steps have been set forth for purposes of describing embodiments of the invention, various modifications can be resorted to, in light of the above teachings, without departing from applicant's novel contributions; therefore in determining the scope of the present invention, reference shall be made to the appended claims.

What is claimed is:

1. In a rolling mill system for rolling metal strip to a predetermined profile, thickness and flatness, a series of roll stands each supporting at least a pair of work rolls for engaging metal strip passing therebetween and a pair of back-up rolls, and means for configuring each roll including bending means and roll-crossing means, the improvement comprising:

a. means for continuously sensing thickness and flatness of the metal strip prior to engagement with the work rolls and generating signals indicative of the thickness and flatness; and b. control means for:
   i) storing data indicative of the predetermined strip profile, thickness and flatness,
   ii) storing data indicative of strip profiles achievable by the roll configuring means,
   iii) storing data indicative of secondary effects of roll configurations,
   iv) receiving the signals from the sensing means,
   v) determining strip profile from the sensing means' signals
   vi) generating information indicative of all the roll configurations available to achieve the predetermined profile, thickness and flatness,
   vii) determining a preferred configuration of the rolls based on secondary effects,
   viii) generating control signals indicative of the preferred configuration, and
   ix) sending the control signals to the means for configuring each roll.

2. A rolling mill system according to claim 1, wherein each stand of the series of roll stands is a 5 or 6 roll stand, and each stand supports at least one intermediate roll between one of the work rolls and one of the back-up rolls.

3. A rolling mill system according to claim 1, further comprising means for continuously sensing thickness and flatness of the metal strip following engagement with the work rolls and generating signals indicative of the strip thickness and flatness, and control means for:

i) receiving the signals from the sensing means, ii) determining strip profile from the sensing means' signals iii) determining correction factors for the roll configurations, iv) generating control signals indicative of the correction factors, and v) sending the control signals to the means for configuring each roll.

4. A rolling mill system according to claim 1, wherein said bending means comprise apparatus for positive or negative bending of any one of the rolls, and said crossing means comprise apparatus for crossing solely one of the rolls, "paired" crossing, or "dual" crossing.

5. A rolling mill system according to claim 1, wherein said predetermined strip profile comprises a relative center crown between about 1 to 3%.

6. A rolling mill system according to claim 1, wherein said roll crossing means provide for roll crossing up to about 2°.

7. A method for rolling metal strip to a predetermined profile, thickness and flatness in a series of roll stands each supporting at least a pair of work rolls for engaging metal strip passing therebetween and a pair of back-up rolls, means for configuring each roll including bending means and roll crossing means, and means for continually sensing thickness and flatness of the metal strip prior to engagement with the work rolls and generating signals indicative of said thickness and flatness, comprising, providing control means, and with continuous use of the control means while rolling a metal strip a. storing information indicative of the predetermined thickness, profile and flatness, b. storing information indicative of strip profiles achievable by the roll configuring means, c. storing information indicative of secondary effects caused by the roll configuration, d. receiving the signals from the sensing means, e. determining strip profile from the sensing means' signals, f. determining the roll configurations available for achieving the predetermined thickness, profile and flatness by using information from a, b, d, and e g. determining the preferred roll configuration for achieving the predetermined profile, thickness and flatness with use of information from c and e, h. generating control signals indicative of the preferred roll configuration, i. sending the control signals to the configuring means, and j. configuring the rolls in accordance with the control signals.

8. A method for rolling metal strip according to claim 7, further comprising providing means for continually sensing the thickness and flatness of the metal strip following engagement with the work rolls, generating signals indicative of said thickness and flatness, receiving said signals indicative of said thickness, profile and flatness in the control means, determining strip profile from the sensing means' signals, determining corrections to the roll configurations for achieving the predetermined thickness, profile and flatness by using information stored in the controller, generating control signals indicative of the corrections, sending the control signals to the configuring means, and configuring the rolls in accordance with the control signals.

9. A method for rolling metal strip according to claim 7, wherein said bending comprises positive or negative bending of any one of the rolls, and said roll crossing comprises crossing of solely one of the rolls, "paired" crossing, or "dual" crossing.

10. A method for rolling metal strip according to claim 7, wherein the preferred roll configuration, in order of most preferred to least preferred, is a. roll bending without roll crossing b. intermediate roll crossing c. dual roll crossing d. pair roll crossing e. work roll crossing.

11. A method for rolling metal strip according to claim 7, wherein said predetermined strip profile comprises a relative center crown between about 1 to 3%.

12. A method for rolling metal strip according to claim 7, wherein roll crossing is carried out up to about 2°.

13. A method for rolling metal strip according to claim 7, wherein said information in the control means indicative of the strip profile comprises polynomial functions of at least a fourth order.

* * * * *